US006896538B2

(12) United States Patent
Grubbs

(10) Patent No.: US 6,896,538 B2
(45) Date of Patent: May 24, 2005

(54) SELF-CLEANING CPA DEVICE FOR HIGH-DEBRIS APPLICATIONS

(75) Inventor: Jimmy G. Grubbs, Walkertown, NC (US)

(73) Assignee: Tyco Electronics Corporation, Middletown, PA (US)

( * ) Notice: Subject to any disclaimer, the term of this patent is extended or adjusted under 35 U.S.C. 154(b) by 84 days.

(21) Appl. No.: 10/284,903

(22) Filed: Oct. 31, 2002

(65) Prior Publication Data

US 2004/0087206 A1 May 6, 2004

(51) Int. Cl.[7] ..... H01R 13/627
(52) U.S. Cl. ..... 439/352; 439/489
(58) Field of Search ..... 439/352, 157, 439/489, 353, 372, 488, 923

(56) References Cited

U.S. PATENT DOCUMENTS

| | | | | |
|---|---|---|---|---|
| 5,641,300 A | | 6/1997 | Corrion | 439/352 |
| 5,643,003 A | | 7/1997 | Myer et al. | 439/352 |
| 6,435,895 B1 | * | 8/2002 | Fink et al. | 439/352 |
| 6,468,105 B2 | * | 10/2002 | Noguchi et al. | 439/489 |
| 6,514,098 B2 | * | 2/2003 | Marpoe et al. | 439/352 |
| 6,568,954 B2 | * | 5/2003 | Endo et al. | 439/489 |
| 6,579,118 B2 | * | 6/2003 | Endo | 439/489 |
| 6,582,243 B2 | * | 6/2003 | Endo et al. | 439/352 |
| 6,641,424 B1 | * | 11/2003 | Hanak et al. | 439/352 |
| 2002/0115332 A1 | | 8/2002 | Myer et al. | 439/352 |

FOREIGN PATENT DOCUMENTS

| | | | |
|---|---|---|---|
| EP | 0 851 535 A2 | 7/1998 | H01R/13/436 |
| EP | 1 235 311 A2 | 8/2002 | H01R/13/639 |

* cited by examiner

*Primary Examiner*—Ross Gushi
*Assistant Examiner*—Phuongchi Nguyen

(57) ABSTRACT

An electrical connector assembly is provided, including a connector position assurance device (CPA) movable between locked and unlocked positions along a longitudinal axis of the CPA. The CPA includes rails. The connector assembly also includes first and second connector housings having mating ends configured to mate with one another. A CPA guide assembly is mounted to at least one of the first and second connector housings. The CPA guide assembly includes CPA guide rails slidably accepting the guide rail of the CPA. The CPA permits engagement and disengagement of the first and second connector housings when in the unlocked position. The CPA prevents disengagement of the first and second connector housings when in the locked position. When the first and second connector housings are disengaged, the CPA can not move to the locked position. The connector assembly further includes a sweeping element mounted to the CPA. The sweeping element is configured to extend laterally from the longitudinal axis of the CPA and positioned to provide a wedge to remove debris from the housing of the connector as the CPA is moved to the unlocked position. The debris builds up on the connector assembly while engaged and the CPA is locked. The removal of the debris occurs during movement of the CPA to the unlocked position because it is then that a connector latch should deflect to release the mating connector.

20 Claims, 6 Drawing Sheets

SELF-CLEANING CPA DEVICE FOR HIGH-DEBRIS APPLICATIONS

BACKGROUND OF THE INVENTION

Certain embodiments of the present invention generally relate to an electrical connector assembly that includes a self-cleaning connector position assurance device (CPA) that ensures matable connectable halves are fully mated with another.

Connector devices have been proposed that provide electrical terminals having matable male to female connector halves. One of the male and female connector halves may include a resilient latch that locks behind a feature on the complementary connector half. When the connector halves are mated, a CPA is inserted to a locked position indicating that the connector halves are fully mated. The CPA is movable between a locked position indicating that the connector halves are mated and an unlocked position permitting unmating of the connector halves. An example of a connector assembly including a CPA may be found in U.S. Pat. No. 5,643,003. Some applications, however, require sealing to protect components from contamination from external sources. An example of a sealed connector assembly with a CPA can be found at U.S. patent application Publication No. U.S. 2002/0115332A1 entitled "Connector Position Assurance Device For A Sealed Connector," published Aug. 22, 2002.

Some electrical connector applications involve use in high-debris environments, such as in construction equipment that is exposed to mud and dirt. In these applications, debris may accumulate on the connector when in the locked position. The debris may prevent the connector halves from being unmated. More specifically, debris, such as mud, may accumulate around the resilient latch securing the connector halves together. As the CPA is moved to the unlocked position, the debris becomes packed under the resilient latch which prevents the resilient latch from being deflected to a position at which it would otherwise release a latch feature on the mated connector half. If the latch cannot be deflected, the connector halves cannot be unmated. An operator in the field must then remove the debris from the connector, a process that consumes valuable time and may result in damage to the CPA, latch, or other connector components. A secondary problem with conventional connectors is that the debris renders it more difficult to move the CPA.

A need exists for an improved CPA connector assembly to overcome the above-noted and other disadvantages of conventional connectors.

BRIEF SUMMARY OF THE INVENTION

An electrical connector assembly is provided, including a connector position assurance device (CPA) movable between locked and unlocked positions along a longitudinal axis of the CPA. The CPA includes rails. The connector assembly also includes first and second connector housings having mating ends configured to mate with one another. A CPA guide assembly is mounted to at least one of the first and second connector housings. The CPA guide assembly includes CPA guide rails slidably accepting the guide rail of the CPA. The CPA permits engagement and disengagement of the first and second connector housings when in the unlocked position. When the first and second connector housings are disengaged, the CPA can not move to the locked position. The connector assembly further includes a sweeping element mounted to the CPA. The sweeping element is configured to extend laterally from the longitudinal axis of the CPA and positioned to provide a wedge to remove debris from the housing of the connector as the CPA is moved to the unlocked position.

In at least one embodiment, the connector assembly is formed with a resiliently deflectable latch assembly mounted to, and being positioned above, one of the first and second connector housings. The latch assembly is spaced from the corresponding first and second connector housing to define a gap therebetween. The sweeping element of the CPA is positioned to remove debris from the gap and to block entry of additional debris when the CPA is in the locked position.

In accordance with at least one embodiment, multiple sweeping elements may be formed on the CPA with sloped surfaces extending laterally from either side of the CPA. The sloped surfaces may be formed at an acute or an obtuse angle with respect to one another. The CPA may also be provided with a blocking portion aligned to prevent debris from collecting under a latch assembly mounted to one of the first and second connector housings.

Certain embodiments of the present invention thus provide an electrical connector system that performs better in high-debris applications by removing debris and/or preventing accumulation of debris.

Figure 1:
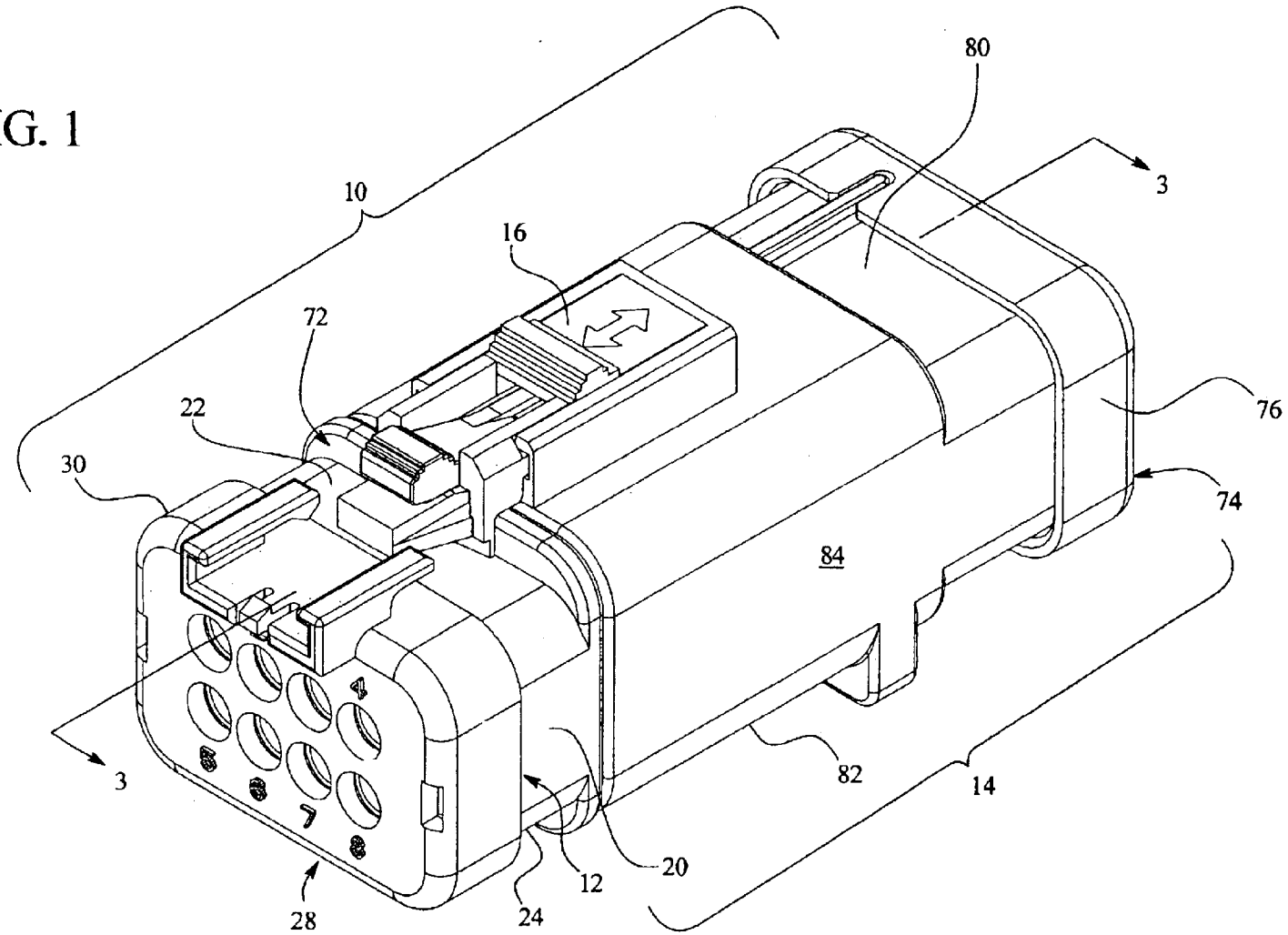
FIG. 1 illustrates an isometric view of a connector system with a CPA in a locked position, formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 2:
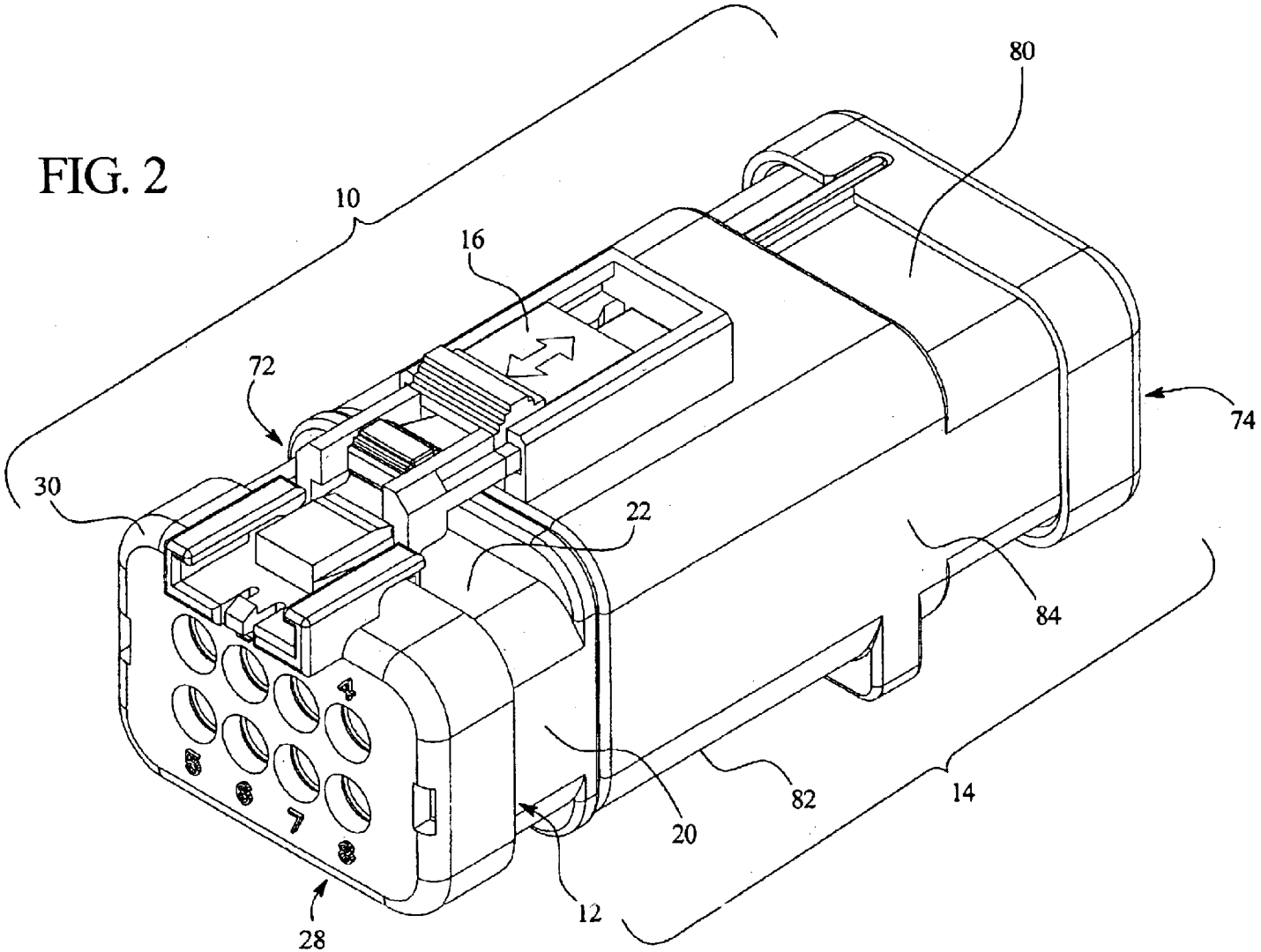
FIG. 2 illustrates an isometric view of a connector system with a CPA in an unlocked position, formed in accordance with an embodiment of the present invention.

FIGS. 1 and 2 illustrate isometric views of a connector system 10. The connector system 10 includes a plug connector housing 12 that is mated to a cap connector housing 14. The connector system 10 also includes a connector position assurance device (CPA) 16 movable between locked and unlocked positions. In the locked position, as illustrated in FIG. 1, the CPA 16 indicates that the plug connector housing 12 and cap connector housing 14 are fully mated and prevents the separation of the mated plug and cap connector housings 12 and 14. In the unlocked position, illustrated in FIG. 2, the CPA 16 permits the separation of the plug and cap connector housings 12 and 14.

Figure 3:
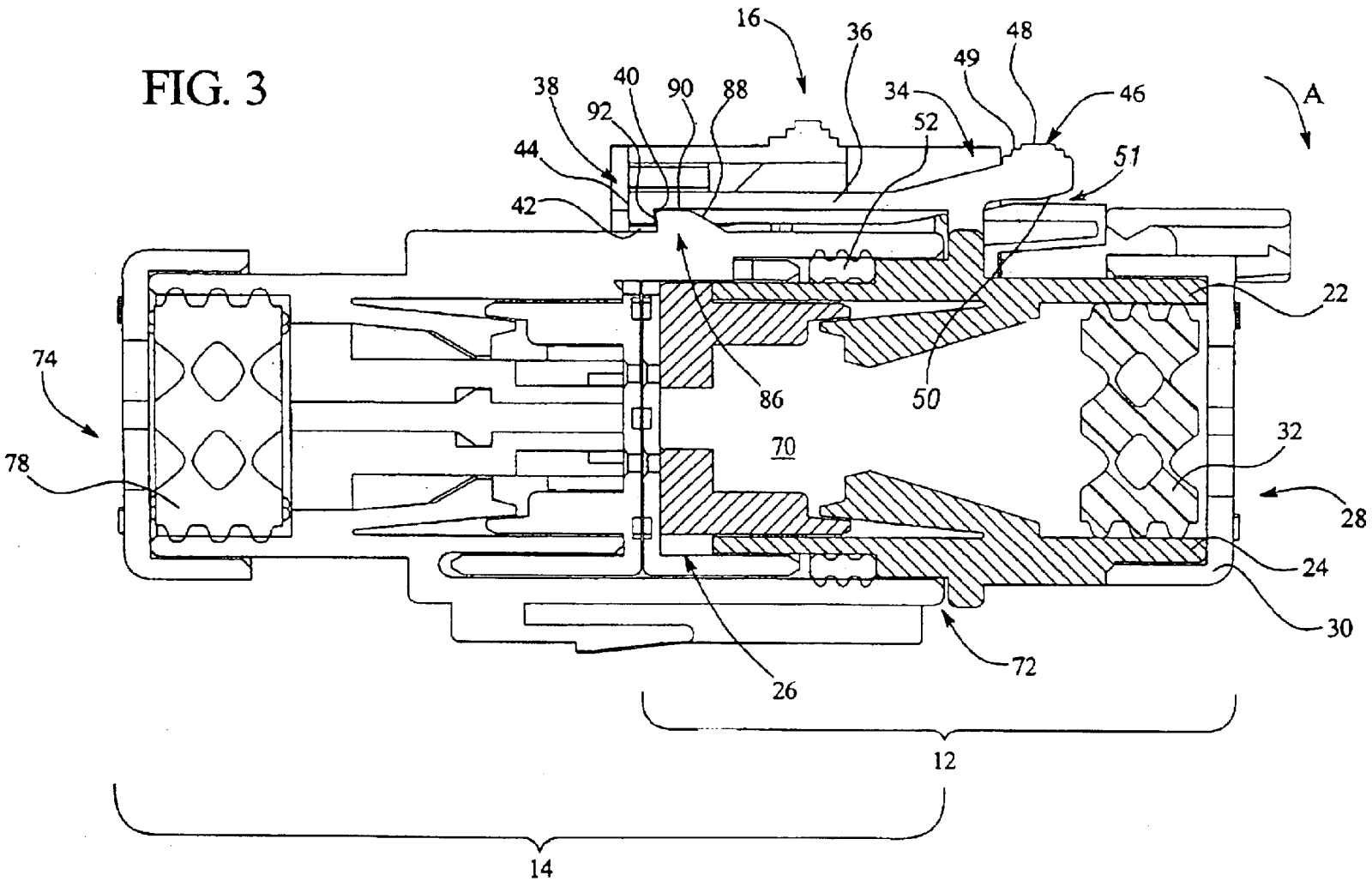
FIG. 3 illustrates a side section taken along line 3—3 in FIG. 1 of the connector system with the CPA in the locked position.

FIG. 3 illustrates a side sectional view taken along line 3—3 of FIG. 1, with the plug connector housing 12 and cap connector housing 14 mated, and the CPA 16 in the locked position. With reference to FIGS. 1–2, the plug connector housing 12 includes sides 20 joining a top portion 22 and a bottom portion 24. Also, the plug connector housing 12 includes a mating end 26 and a back end 28 (FIG. 3). The mating end 26 includes a plug contact array (not shown) that contacts and electrically communicates with a corresponding cap contact array (not shown). Proximal to the back end 28, the plug connector housing 12 includes a wire seal 32, through which a wire harness (not shown) passes. The illustrated embodiment is an 8 position connector having contacts arranged in two rows of four contacts each. The wire harness is in electrical communication with the plug contact array. The plug connector housing 12 also includes a plug cap 30 that is placed over the back end 28 to maintain the wire seal 32 in position and to help prevent debris from entering the interior of the plug connector housing 12.

The top portion 22 of the plug connector housing 12 includes a latch assembly 34. The latch assembly includes a resilient latch arm 36. The latch assembly 34 is resiliently deflectable in direction A, pivoting about a point located intermediately along its length, to permit engagement and disengagement of the plug connector housing 12 and cap connector housing 14. Proximal to the mating end 26 of the plug connector housing 12, the latch assembly 34 terminates at a retention feature 38. The retention feature 38 includes a retention surface 40 extending away from the bottom of the latch arm 36. The retention surface 40 cooperates with the cap connector housing 14 to maintain the plug connector housing 12 and cap connector housing 14 in a mated position after the plug connector housing 12 and cap connector housing 14 are mated. Extending substantially horizontally from an edge of the retention surface 40 is a bottom surface 42. The bottom surface 42 joins the retention surface 40 to a front surface 44 that is substantially parallel to the retention surface 40. The front surface 44 cooperates with the cap connector housing 14 to prevent the entry of debris proximal to the mating end 26 to the area around the latch assembly 34.

Opposite to the retention feature 38 along the length of the latch arm 36, the latch assembly 34 includes a finger bump 46. The finger bump 46 includes a top 48 and a bottom 50. The top 48 includes a sloped surface 49 leading from the latch arm 36 toward the back of the latch assembly 34. An operator can push in the downward direction of FIG. 3 on the top 48 of the finger bump 46 to release the latch assembly 34, as pushing downward on the finger bump 46 biases the latch assembly 34 in direction A, causing the retention feature 38 to move upward. However, when the CPA 16 is in the locked position, as shown in FIG. 3, the bottom 50 of the finger bump 46 contacts the CPA 16 which prevents the biasing along direction A, thereby preventing the release of the latch assembly 34 and maintaining the plug connector housing 12 and cap connector housing 14 in a fully mated position.

The plug connector housing 12 further includes a seal 52 surrounding an outside surface defined along an exterior surface along the sides 20, top 22, and bottom 24 of the plug connector housing 12 located proximal to the mating end 26. The seal cooperates with the plug connector housing 12 and cap connector housing 14 to prevent debris from entering the interior of the plug connector housing 12 and cap connector housing 14 when they are mated.

Figure 4:
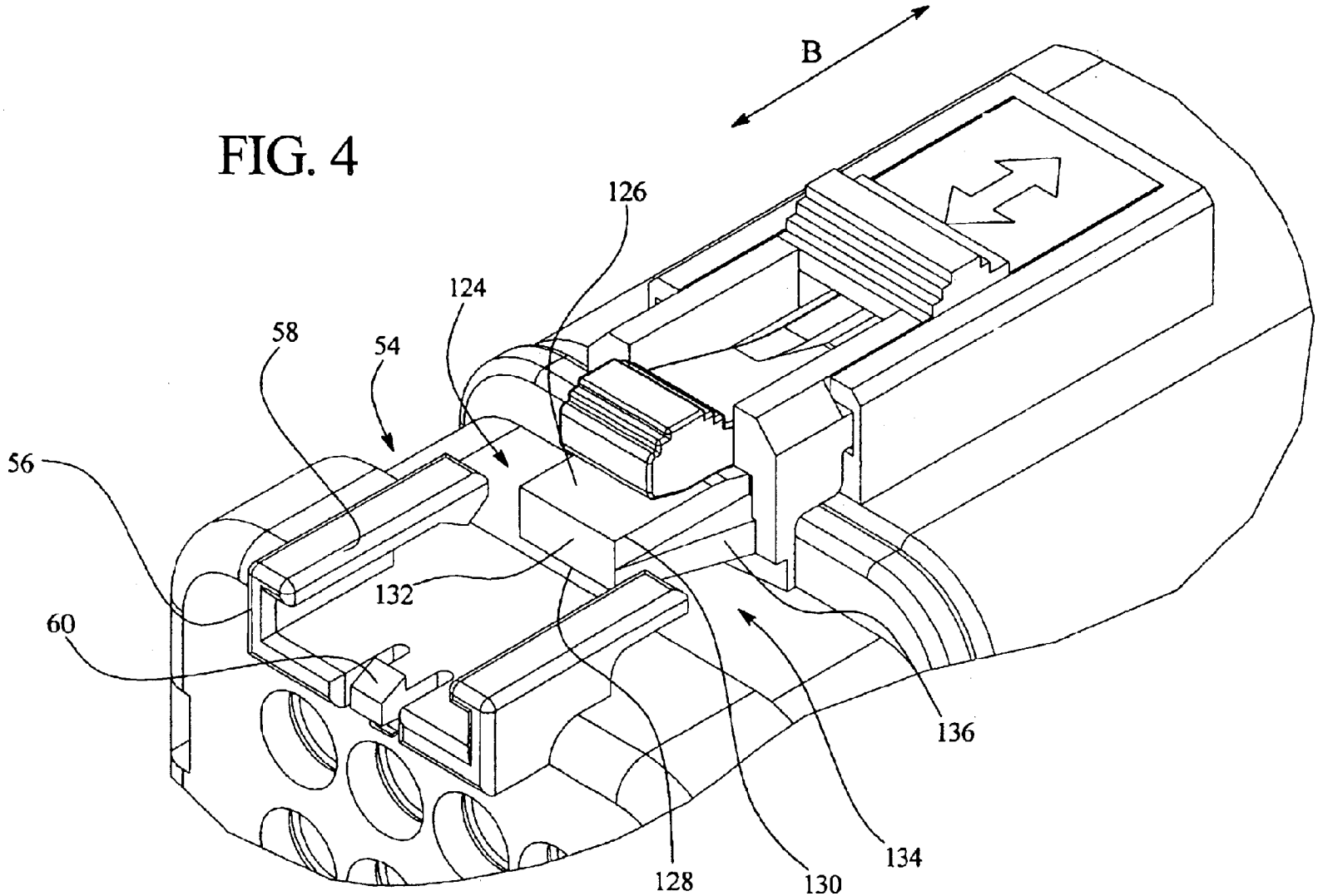
FIG. 4 illustrates a partial isometric view of a portion of the connector system and CPA in the locked position of FIG. 1.

Turning to FIG. 4, proximal to the back end 28 of the plug connector housing 12, the top portion 22 of the plug connector housing 12 and/or the plug cap 30 include a CPA holder 54. The CPA holder 54 functions to retain the CPA 16 when the CPA 16 is in the unlocked position and/or the plug connector housing 12 and cap connector housing 14 are separated. The CPA holder 54 includes two CPA holder rails 56 extending from the top portion 22, facing one another and configured to slidably accept the CPA 16. The CPA holder rails 56 include CPA holder rail top ledges 58, which prevent the CPA 16 from moving upward away from the top portion 22 of the plug connector housing 12. The CPA holder 54 also includes a CPA retention feature 60 that is configured to prevent the CPA 16 from entirely sliding off the back end 28 of the plug connector housing 12.

As shown in FIGS. 1–3, the cap connector housing 14 includes a front end 72 and a back end 74. Proximal to the front end 72, the cap connector housing 14 also includes an opening 70 (FIG. 3) configured to accept the mating end 26 of the plug connector housing 12. Further, the cap connector housing 14 includes a top portion 80 and a bottom portion 82 joined by sides 84. The front end 72 includes a cap contact array (not shown) that contacts and electrically communicates with the corresponding plug contact array (not shown). Proximal to the back end 74 of the cap connector housing 14, the cap connector housing 14 includes a wire seal 78, through which a wire harness (not shown) passes. The wire harness is in electrical communication with the cap contact array. The cap connector housing 14 also includes a back cap 76 that is placed over the back end 74 to maintain the wire seal 78 in position and to help prevent debris from entering the interior of the cap connector housing 14.

As shown in FIG. 3, the cap connector housing 14 includes a latch bump 86 extending from the top portion 80 of the cap connector housing 14. The latch bump 86 cooperates with the latch assembly 34 to maintain the plug connector housing 12 and cap connector housing 14 in a mated position. The latch bump 86 includes a sloped surface 88 extending generally upward from the top portion 80 and towards the back end 74. The sloped surface 88 terminates at a substantially horizontal top surface 90. The top surface 90 joins a latch retention surface 92 that is substantially vertical and extends back toward the top portion 80 from the edge of the top surface 90.

Figure 5:
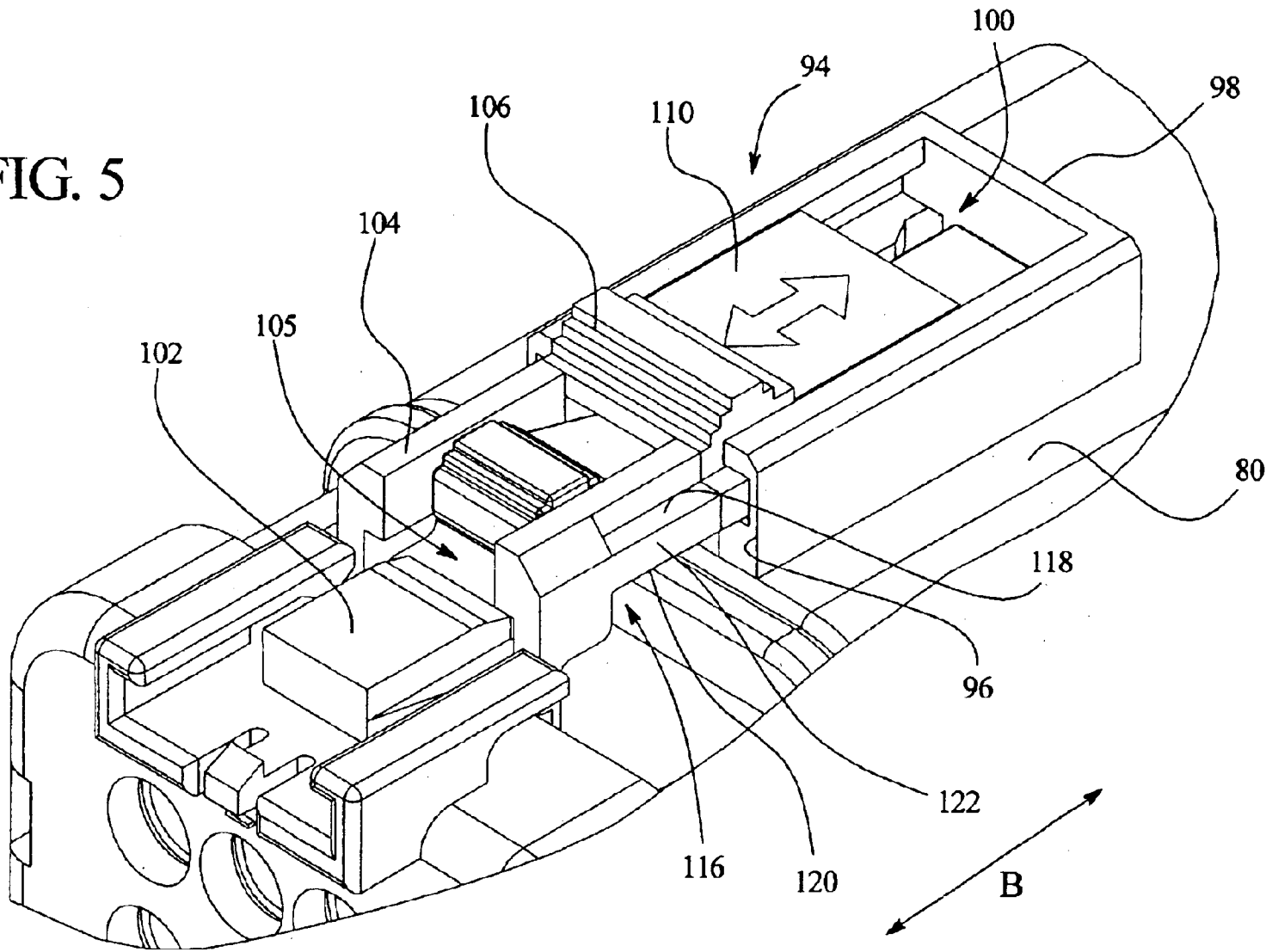
FIG. 5 illustrates a partial isometric view of a portion of the connector system and CPA in the unlocked position of FIG. 2.

With reference to FIG. 5, the cap connector housing 14 also includes a CPA guide 94 extending from the top portion 80. The CPA guide 94 includes two CPA guide rails 96. The CPA guide rails 96 are generally C-shaped and are sized and configured to slidably accept the CPA 16. At ends nearest the back end 74 of the cap connector housing 14, the CPA guide rails 96 are joined by a back surface 98. The back surface 98 is substantially vertical and cooperates with the latch assembly 34 and/or the latch bump 86 to prevent debris from entering the area beneath the latch assembly 34 from the direction from the back end 74 of the cap connector housing 14. The CPA 16 is moved along direction B between the locked and unlocked positions. In FIG. 4, the CPA 16 is in the locked position, and in FIG. 5 the CPA 16 is in the unlocked position.

Figure 6:
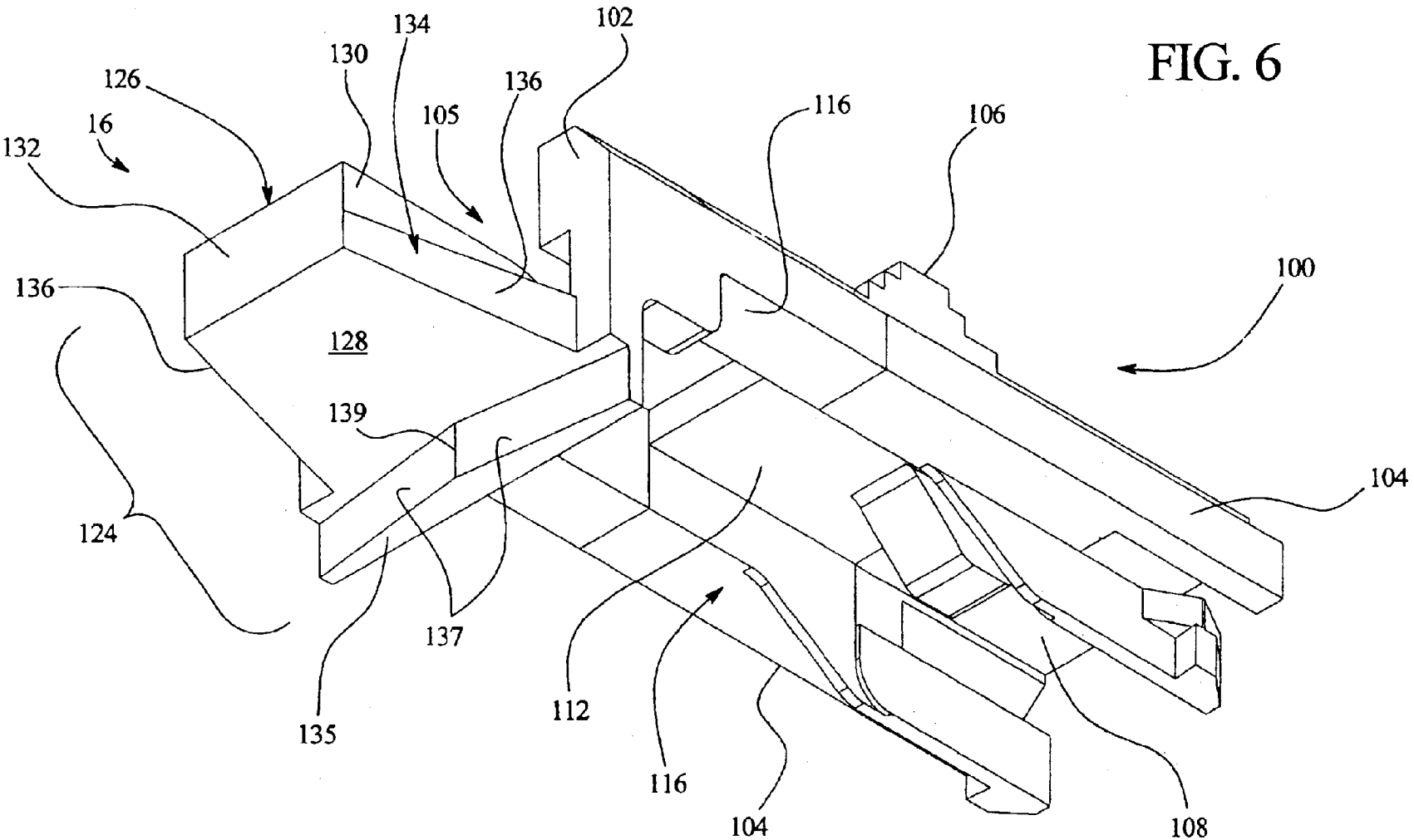
FIG. 6 illustrates a bottom isometric view of a CPA with sweeping and blocking elements formed thereon in accordance with an embodiment of the present invention.

FIG. 6 illustrates a bottom isometric view of the CPA 16. The CPA 16 includes a front portion 100 and a back portion 102 joined by sides 104. The front portion 100, back portion 102, and sides 104 define an open channel 105 through which the latch assembly 34 may be biased when the CPA 16 is in the unlocked position (FIG. 5). The front portion 100 of the CPA 16 includes a top surface 110 (FIG. 5) and a bottom surface 112 (FIG. 6). The front portion 100 includes a thumb rest 106 extending above the top surface 110. The thumb rest 106 may be used by an operator to move the CPA 16 along direction B between the locked and unlocked positions. The CPA 16 includes a cross member 108 (FIG. 3) extending beneath the bottom surface 112 and parallel to sides 104. The cross member 108 and/or the bottom surface 112 may provide assistance in deflecting the latch assembly 34 when the CPA 16 is moved to the unlocked position. The cross member 108 may also be used to prevent the upward movement of the latch arm 36 when the CPA 16 is in the locked position.

With reference again to FIGS. 4–5, each side 104 of the CPA 16 includes a rail 116 extending therefrom. The rails 116 are configured to be slidably accepted by the CPA guide rails 96 of the cap connector housing 14.

The back portion 102 of the CPA 16 includes a blocking portion 124 with first and second sweeping elements 134 and 135 joined thereto. The blocking portion 124 includes a top surface 126 and a bottom surface 128 joined by sides 130. The blocking portion also includes a back end 132. The blocking portion 124 is positioned underneath the finger bump 46 of the latch assembly 34, preventing downward movement of the finger bump 46 and blocking the entry of debris underneath the latch assembly 34 from the back end 28 of the plug connector housing 12 when the CPA 16 is in the locked position (FIG. 4).

The sweeping element 134 extends from the sides 130 of the blocking portion 124. The sweeping element 134 includes sloped surfaces 136 extending outward from the sides 130 to form an acute angle with a longitudinal axis of the CPA 16. The sweeping element 135 extends below the sweeping element 134 and is oriented perpendicular to the direction B along which the CPA 16 is moved between locked and unlocked positions. The sweeping element 135 includes sloped surfaces 137 joining at an obtuse angle. The sweeping elements 134 and 135 provide wedges or plows to help move the back portion 102 through any accumulated and/or caked in mud or other debris that may be behind the back portion 102 of the CPA 16 when the CPA 16 is moved from the locked position to the unlocked position. The sweeping elements 134 and 135 may also cooperate to block entry of debris underneath the latch assembly 34. Optionally, the sweeping elements 134 and 135 may converge to one or more lead edges similar to the lead edge 139 formed at the intersection of sloped surfaces 137.

The mating (engagement) and unmating (disengagement) processes for the connector system 10 will now be described. First, the plug connector housing 12 and cap connector housing 14 are positioned such that the mating end 26 of the plug connector housing 12 faces toward the front end 72 of the cap connector housing 14 and the top portions 22, 80 of the plug connector housing 12 and cap connector housing 14, respectively, are aligned. The CPA 16 is in the unlocked position and held by the CPA holder 54 of the plug connector housing 12. Aligned as described, the plug connector housing 12 and cap connector housing 14 are then urged toward each other. The mating end 26 of the plug connector housing 12 is accepted in the opening 70 of the cap connector housing 14, and the rails 116 of the CPA 16 (with the CPA 16 still in the unlocked position) are accepted by the CPA guide rails 96 of the cap connector housing 14.

As the mating end 26 enters the opening 70, the latch assembly 34 is resiliently biased. The front surface 44 of the latch assembly 34 encounters the sloped surface 88 of the latch bump 86 of the cap connector housing 14. As the front surface 44 rides along the sloped surface 88, the latch assembly 34 is biased along direction A. Eventually, the front surface 44 passes the sloped surface 88, and the bottom surface 42 of the latch assembly 34 rides along the top surface 90 of the latch bump 86. Further entry of the plug connector housing 12 into the cap connector housing 14 results in the bottom surface 42 passing the top surface 90. The latch assembly 34 then snaps back to its original unbiased position, with the retention surface 40 of the latch assembly 34 now abutting the latch retention surface 92 of the latch bump 86. At this point, the respective contact assemblies of the plug connector housing 12 and cap connector housing 14 are in the desired final position providing electrical communication, and the connector system 10 is fully mated. With the latch assembly 34 positioned as such, the retention surface 40 and the latch retention surface 92 cooperate to maintain the plug connector housing 12 and cap connector housing 14 together. Further, the front surface 44 of the latch assembly 34 cooperates with the back surface 98 of the cap connector housing 14 to help prevent debris from accumulating near the latch assembly 34. To separate the plug connector housing 12 and cap connector housing 14, the latch assembly 34 must be deflected such that the retention surface 40 is clear of the latch retention surface 92.

The CPA 16 may be moved to the locked position to prevent deflection of the latch assembly 34 and engagement or disengagement of the plug connector housing 12 and cap connector housing 14. With the plug connector housing 12 and cap connector housing 14 fully mated, the CPA 16 may be advanced from the unlocked position to the locked position. In the locked position, the blocking portion 124 of the CPA 16 resides beneath the finger bump 46 of the latch assembly 34, preventing downward deflection of the finger bump 46. Thus, the latch assembly 34 is prevented from biasing when the CPA 16 is in the locked position, thereby keeping the plug connector housing 12 and cap connector housing 14 from being separated. The blocking portion 124 also substantially blocks the portion of the volume 51 beneath the finger bump 46, thereby substantially closing off the volume 51. Thus, the CPA 16 prevents the entry and accumulation of debris under the latch assembly 34 that could inhibit retraction of the CPA 16 to the unlocked position and/or deflection of the latch assembly 34 when it is desired to separate the plug connector housing 12 and the cap connector housing 14.

To unmate the plug connector housing 12 and cap connector housing 14, the CPA 16 is moved to the unlocked position (FIGS. 2 and 5). If debris has accumulated behind the CPA 16, blocking its movement, the sweeping element 134 provides a plow to facilitate movement through and removal of the debris. Additionally, the cross member 108 may also assist in the removal of and movement through any debris that may have accumulated beneath the bottom surface 112 of the front portion 100 of the CPA 16. Because the CPA 16 helps prevent accumulation of debris in the volume 51 and also acts to remove debris during the course of its movement to the unlocked position, once the CPA 16 is in the unlocked position, the latch assembly 34 may be deflected without interference from debris, allowing separation of the plug connector housing 12 and cap connector housing 14. Additionally, the cross member 108 of the CPA 16 may ride along the sloped surface 49 of the finger bump 46 to assist in the deflection of the latch assembly 34 during unmating. As a further option, a sweeping element may be added proximal to the thumb rest 106 to assist in the movement of the CPA 16 should debris accumulate near the thumb rest 106.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An electrical connector assembly comprising:

a connector position assurance device (CPA) movable between locked and unlocked positions including a rail;

a first connector housing having a mating end;

a second connector housing matable to said first connector housing, said second connector housing having an opening configured to accept said mating end of said first connector housing;

a CPA guide assembly mounted to one of said first connector housing and second connector housing, said CPA guide assembly including a CPA guide rail slidably accepting said rail of said CPA, and the other of said first connector housing and second connector housing including a CPA holder, said CPA permitting engagement and disengagement of said first connector housing and said second connector housing when in said unlocked position; and a sweeping element mounted to said CPA, said sweeping element extending laterally from said CPA providing a wedge to remove debris as said CPA is moved to said unlocked position.

2. The electrical connector assembly of claim 1 further comprising a resiliently deflectable latch assembly mounted to, and being positioned above, one of said first connector housing and said second connector housing, said latch assembly defining a gap beneath said latch assembly, said CPA substantially blocking said gap to prevent the entry of debris into said gap when said CPA is in said locked position.

3. The electrical connector assembly of claim 1 wherein said CPA includes sloped surfaces extending from sides of said CPA, said sloped surfaces removing debris from a surface of one of said first and second connector housings when said CPA is moved to said unlocked position.

4. The electrical connector assembly of claim 1 further including a deflectable latch assembly mounted to one of said first connector housing and said second connector housing and a latch bump mounted to the other of said first connector housing and said second connector housing, said latch assembly and said latch bump engaging each other to prevent said second connector housing and said first connector housing from separating once mated, said latch assembly being deflectable to permit disengagement of said second connector housing and said first connector housing, said CPA preventing deflection of said latch assembly when said CPA is in said locked position.

5. The electrical connector assembly of claim 1 wherein said CPA includes a front portion and a back portion joined by sides, said CPA guide assembly including at least two said guide rails opposite each other and corresponding to said sides, each of said sides including at least one said rail slidably accepted by one of said guide rails.

6. The electrical connector assembly of claim 1 wherein said sweeping element includes sloped surfaces extending from a back portion of said CPA, said sloped surfaces forming an obtuse angle therebetween.

7. The electrical connector system of claim 1 further including a deflectable latch assembly having a top surface, said deflectable latch assembly being mounted to one of said first and second connector housings, said CPA including a cross member mounted proximal to a front portion of said CPA, said cross member extending from a bottom surface of said front portion of said CPA to substantially abut said top surface of said deflectable latch assembly.

8. An electrical connector assembly comprising:

a connector position assurance device (CPA) movable between locked and unlocked positions;

a first connector housing having a mating end;

a second connector housing matable to said first connector housing;

a resiliently deflectable latch assembly mounted to one of said first and second connector housings, said latch assembly defining a volume beneath said latch assembly;

a CPA guide assembly mounted to the other of said first and second connector housings, said CPA guide assembly slidably accepting said CPA; and a blocking portion located on said CPA to block entry of debris into said volume when said CPA is in said locked position.

9. The electrical connection system of claim 8, further comprising:

a latch retention assembly mounted to the other of said first and second connector housings, said latch assembly and said latch retention assembly engaging each other to prevent said first and second connector housings from separating once mated, said latch assembly being deflectable to permit disengagement of said first and second connector housings, said CPA preventing deflection of said latch assembly and disengagement of said first and second connector housings when said CPA is in said locked position, said CPA permitting deflection of said latch assembly and disengagement of said first and second connector housing when said CPA is in said unlocked position.

10. The electrical connector system of claim 8 wherein said CPA further includes a sweeping element including a sloped surface extending laterally from said blocking portion to provide a wedge to remove debris from said volume when said CPA is moved to said unlocked position.

11. The electrical connector system of claim 8 further comprising a seal interposed between an exterior surface of said mating end of said first connector housing and said opening of said second connector housing.

12. The electrical connector system of claim 8 wherein said CPA includes a front portion and a back portion joined by sides, said CPA guide assembly including at least two guide rails opposite each other and corresponding to said sides, each of said sides including at least one rail slidably accepted by one of said guide rails.

13. The electrical connector system of claim 8 wherein said blocking portion is mounted proximal to a back portion of said CPA.

14. The electrical connector system of claim 8 wherein said latch assembly includes a top surface and said CPA includes a cross member mounted proximal to a front portion of said CPA, said cross member extending from a bottom surface of said front portion of said CPA to substantially abut said top surface of said latch assembly.

15. An electrical connector system comprising:

a connector position assurance device (CPA) movable along an axis between locked and unlocked positions, said CPA including a sweeping element and a blocking portion, said sweeping element including a sloped surface extending laterally from said axis of said CPA providing a wedge for debris removal;

a plug housing having a mating end and a resiliently deflectable latch assembly, said latch assembly defining a volume between said latch assembly, said blocking portion of said CPA substantially blocking the entry of debris into said volume when said CPA is in said locked position; and a cap housing matable to said plug housing.

16. The electrical connector system of claim 15, wherein said cap housing has an opening configured to accept said mating end of said plug housing, said cap housing having a latch retention assembly, said latch retention assembly cooperating with said latch assembly of said plug housing to maintain said plug housing and said cap housing in a mated position, said latch assembly being deflectable to permit disengagement of said cap housing and said plug housing.

17. The electrical connector system of claim 15, further comprising:

a CPA guide assembly mounted to at least one of said plug housing and said cap housing, said CPA guide assembly including CPA guide rails that slidably accept said rails of said CPA, said CPA preventing deflection of said latch assembly and disengagement of said first and second connector housings when said CPA is in said locked position, said CPA permitting deflection of said latch assembly and disengagement of said first and second connector housing when said CPA is in said unlocked position.

18. The electrical connector system of claim 15 further comprising first and second sweeping elements, said first sweeping element extends laterally from said blocking portion, said second sweeping element being located below said blocking portion.

19. The electrical connector system of claim 15, wherein said latch assembly includes a top surface and said CPA includes a cross member mounted proximal to a front portion of said CPA, said cross member extending from a bottom surface of said front portion of said CPA to substantially abut said top surface of said latch assembly.

20. The electrical connection system of claim 15, wherein said sweeping element includes a pair of sloped surfaces and a lead edge defined at a point of intersection between said sloped surfaces.

* * * * *